United States Patent [19]

Lungers

[11] Patent Number: 4,803,761

[45] Date of Patent: Feb. 14, 1989

[54] PROCESS FOR REGULATING THE CLOTH TENSION ON CYLINDER NAPPING MACHINES

[75] Inventor: Karl H. Lungers, Tonisvorst, Fed. Rep. of Germany

[73] Assignee: Leo Sistig KG, Fed. Rep. of Germany

[21] Appl. No.: 927,763

[22] Filed: Nov. 6, 1986

[30] Foreign Application Priority Data

Nov. 16, 1985 [DE] Fed. Rep. of Germany ..... 3540689

[51] Int. Cl.[4] ..... D06L 11/00

[52] U.S. Cl. ..... 26/35; 364/470

[58] Field of Search ..... 26/33, 34, 35; 364/470

[56] References Cited

U.S. PATENT DOCUMENTS

| | | | |
|---|---|---|---|
| 2,923,046 | 2/1960 | Scholaert | 26/29 R |
| 3,373,468 | 3/1968 | Mullers | 26/29 R |
| 3,857,023 | 12/1974 | McCall | 26/74 X |

FOREIGN PATENT DOCUMENTS

| | | | |
|---|---|---|---|
| 1106723 | 5/1961 | Fed. Rep. of Germany . | |
| 1078529 | 1/1965 | Fed. Rep. of Germany . | |
| 1760830 | 1/1972 | Fed. Rep. of Germany . | |
| 2701483 | 7/1977 | Fed. Rep. of Germany . | |
| 3213716 | 10/1983 | Fed. Rep. of Germany | 26/18.6 |
| 1522222 | 3/1968 | France . | |
| 2573101-A | 5/1986 | France . | |
| 796729 | 6/1958 | United Kingdom | 26/34 |
| 907658 | 10/1962 | United Kingdom . | |

*Primary Examiner*—Robert R. Mackey

*Attorney, Agent, or Firm*—Jones, Askew & Lunsford

[57] ABSTRACT

This invention concerns a process for monitoring and/or regulating cloth tension of a length of cloth processed on a cylinder napping machine, whereby the napping machine has pile rollers and/or counterpile rollers on the jacket of the cylinder which subject the cloth to pile-raising energy and/or counterpile-raising energy, and a certain set point tension value which assures optimum distribution of cloth tension on the cylinder is set at the cloth inlet and the cloth delivery end of the napping machine, during operation the cloth tension is measured preferably continuously and controlled at the inlet end and the outlet end and the tension values are compared, and in the event of a deviation from the predetermined tension values the respective deviating tension is automatically adjusted again to the predetermined set point value. This invention also concerns a cylinder napping machine with pile rollers and/or counterpile rollers mounted on the jacket of the cylinder, a feed roll at the cloth feed and a delivery roll at the cloth delivery end, and a measurement unit for measuring the cloth tension is provided at the cloth feed and another unit is provided at the cloth delivery end.

4 Claims, 4 Drawing Sheets

PROCESS FOR REGULATING THE CLOTH TENSION ON CYLINDER NAPPING MACHINES

BACKGROUND OF THE INVENTION

This invention concerns a process for monitoring and/or regulating the cloth tension of a length of cloth processed on a cylinder napping machine whereby the napping machine has pile rollers and/or counterpile rollers on the jacket of the cylinder which subject the cloth to pile-raising energy and/or counterpile-raising energy.

In addition, this invention also concerns the napping machine for carrying out the process according to this invention with pile rollers and/or counterpile rollers on the jacket of the cylinder, a feed roll at the cloth feed end plus a delivery roll at the cloth delivery end.

For effective napping of cloth such as woven or knit fabrics, double-action napping machines are generally used, whereby the napping rolls on the jacket of the cylinder are designed as pile rollers and counterpile rollers with wire card clothing. Wires of the pile rollers generally point in the direction in which the fabric travels over the cylinder, and the wires on the counterpile rollers point in the opposite direction. The cloth is effectively napped, i.e., the fibers of the fabric are raised away from the base of the fabric by means of an alternating arrangement of pile rollers and counterpile rollers. However, this results in a loss of tension on the cloth between one pile roller and the next counterpile roller in the direction of feed of the cloth, and there is tension on the cloth between one counterpile roller and the next pile roller. With known napping machines, it is extremely difficult to find the proper balance between pile-raising energy and counterpile-raising energy. Either the cloth is not napped enough, so several processing passages are required to achieve the desired napping effect, or a high ratio of counterpile-raising energy to pile-raising energy can lead to undesirably extreme mapping, damage or even tearing of the cloth might occur in the extreme case. In addition, however, the cloth tension prevailing over the entire cylinder also has an influence on the pile-raising energy and counterpile-raising energy because if the tension is too low, the fabric is transported over the napping rolls practically without contact, but if the tension is too high, too much stress would be placed on the cloth. Processing of highly stretchable cloth is especially problematical with known napping machines because such cloth can undergo an elongation of more than 100% in processing. Optimum processing of cloth on cylinder napping machines thus depends on the amount of pile-raising energy and counterpile-raising energy as well as the total tension on the cloth on the cylinder. However, it is difficult even for trained and experienced personnel to always find the optimum processing parameters especially when it is necessary to process different types of cloth with different properties in succession.

This invention is therefore based on the goal of creating a process whereby monitoring and/or regulation of cloth tension can be automated in order to optimize processing. Furthermore, a cylinder napping machine is described for carrying out this process, whereby the cloth is automatically kept at the optimum tension and is also exposed to the optimum pile-raising energy and/or counterpile-raising energy, but is nevertheless simple in design and thus economical.

SUMMARY OF THE INVENTION

The process according to this invention is characterized by the fact that a certain set point tension value is set at the cloth feed end and at the cloth delivery end on the napping machine to assure an optimum distribution of cloth tension on the cylinder, then during operation the cloth tension is measured and controlled preferably continuously at the feed end and at the delivery end, and the tension values are compared, and in the case of a deviation from the predetermined tension values, the deviating tension value is automatically readjusted to the predetermined set point value. This invention is thus based on the finding that definite information regarding all the important individual parameters that are important for processing can be deduced exclusively from a comparison of the two cloth tension states before and after the cylinder, so the deviating tension value can be adjusted to the set point value, preferably automatically by means of an electronic process computer. This is accomplished according to this invention by varying the differential speed between the feed roll and the delivery roll of the napping machine and/or the ratio of the pile-raising energy to the counterpile-raising energy. To control the cylinder napping machine, it is therefore advantageous for independent drives to be provided for the feed roll, the delivery roll, the cylinder, the pile rollers and the counterpile rollers. It is advantageous to use electronic variable speed DC motors for these drives. The process according to this invention makes it possible to process different types of cloth with a variety of properties immediately in succession without the need to make manual adjustments on the machine on the basis of experience, because all settings are automated.

A cylinder napping machine for carrying out the process according to this invention is characterized by the fact that one measurement unit which measures the cloth tension is provided at the cloth feed end and another is provided at the cloth delivery end. These measurement units are connected to an electronic process computer which compares the prevailing cloth tension status and automatically sets the required equalizing tension on the basis of this comparison.

This invention will now be illustrated in greater detail on the basis of a practical example of a napping machine according to this invention as shown in the figures.

DESCRIPTION OF THE PREFERRED EMBODIMENT

Figure 1:
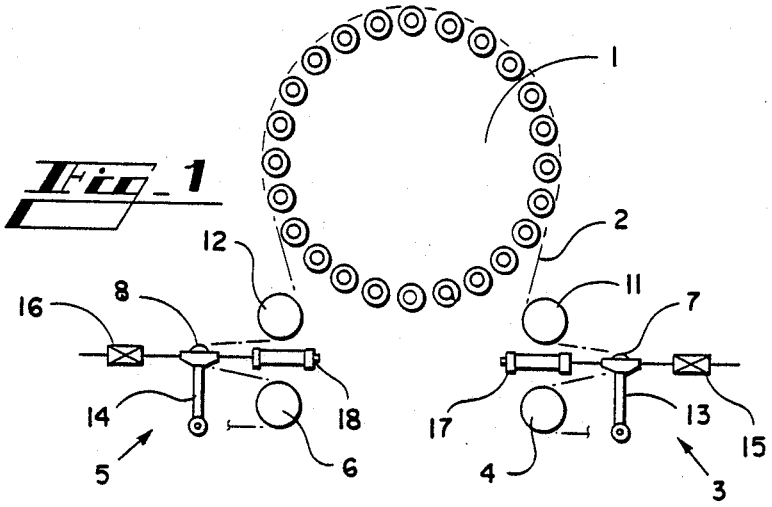
FIG. 1 shows a schematic side view of a cylinder napping machine according to this invention.

The cylinder napping machine according to this invention consists of a cylinder 1 whose jacket is formed from napping rolls of the usual design in a known manner, namely pile rollers and counterpile rollers. Depending on their rotational speed, the pile rollers and counterpile rollers subject the cloth 2 that is to be napped and whose travel path is represented by a dash-dot line to pile-raising energy and/or counterpile-raising energy. A driven feed roll 4 is provided at the cloth feed end 3 and a delivery roll 6 which is also driven is provided at the cloth delivery end 5.

In order to achieve the most uniform possible cloth tension distribution on the cylinder 1, one measurement unit to measure cloth tension is provided according to this invention at the cloth feed end 3 and another is provided at the cloth delivery end 5. The main elements of these measurement units are two dancing rolls 7, 8, which are located between feed roll 4 and cylinder 1 on the one hand and between cylinder 1 and delivery roll 6 on the other hand. The cloth 2 is wrapped around the dancing rolls 7, 8 in the manner of a tube. Due to the arrangement of a guide roll 11, 12 between each of the dancing rolls 7, 8 and the cylinder 1, the angle of wrap of the length of cloth 2 on the feed roll 4, the delivery roll 6 and the dancing rolls 7, 8 is about 180° in each case. According to this invention, the dancing rolls 7, 8 are movable in a direction at right angles to their axis of rotation and in the direction of the tubes of cloth 2 formed by them, and especially they can be pivoted by means of pivot levers 13, 14. Two pivot levers are provided at the side for each dancing roll 7, 8.

Figure 2:
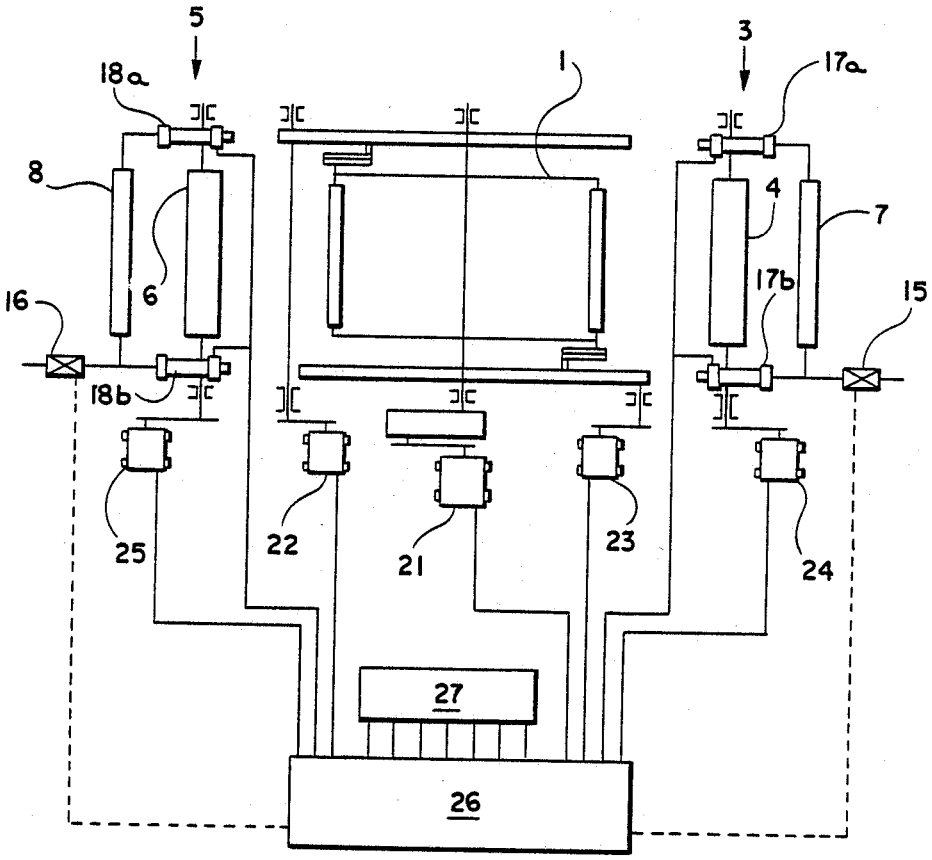
FIG. 2 shows a schematic top view of the napping machine according to FIG. 1 with additional schematic diagrams of the drives and the control system.

Due to this design, any change in the cloth tension at the cloth feed end 3 as well as at the cloth delivery end 5 is measured on the basis of the position of the dancing rolls 7, 8, so each dancing roll 7, 8 is connected according to this invention with a linear analog position feedback transmitter 15, 16 which detects its position. These analog position feedback transmitters 15, 16 may be traditional plunger-type potentiometers, for example, or similar measurement instruments which convert a linear change in position into electric output signals. It is advantageous for the dancing rolls 7, 8 to act in their movement against at least one pressure element 17, 18, which produces a preselected pretension. According to FIG. 2, two pressure elements 17*a*, 17*b*; 18*a*, 18*b* are provided for each dancing roll 7, 8. In this way, a set point cloth tension can be preselected. Pressure elements 17, 18 are preferably designed in the form of pneumatic piston-cylinder units where the amount of pretension can be adjusted in the range from 0 to 300 N. The dancing rolls 7, 8 thus do not actively assure the cloth tension but instead act as passive measurement units that move due to the tension or release of tension in the cloth.

According to this invention, a separate drive is provided for the cylinder 1, the pile rollers, the counterpile rollers, feed roll 4 and delivery roll 6, and especially each is provided with a variable speed DC motor 21, 22, 23, 24, 25. In this way, optimum regulation of the cloth tension can be achieved by adjusting all individual parameters.

The linear analog position feedback transmitters 15, 16, the pressure elements 17, 18 as well as the motors 21 to 25 are connected to an electronic process computer 26. For input of set point values for adaptation to various materials, an input device 27 is connected to the process computer 26.

The electronic process computer 26 receives electric actual value signals, which are proportional to the given tension prevailing in the cloth, from the linear analog position feedback transmitters 15, 16. Computer 26 compares the values and calculates from them the required tension equalization in each case which is subsequently set by optimum speed adjustment of all individual drive mechanisms.

Operation of the cylinder napping machine according to this invention is explained in greater detail below with reference to the tension states illustrated in FIGS. 3 to 8.

Figure 3:
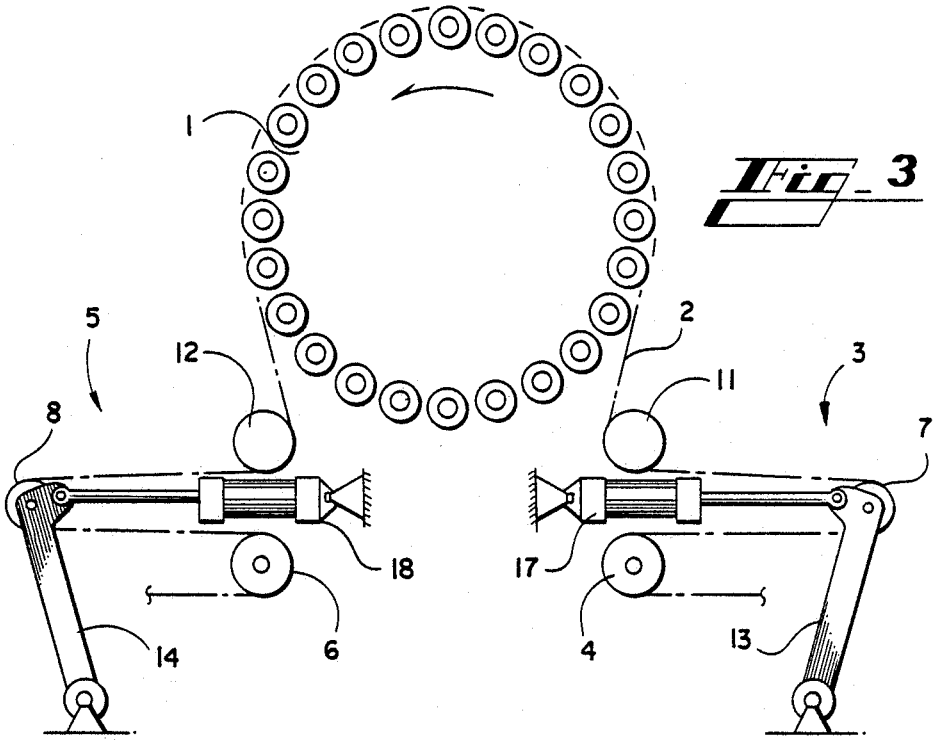
FIGS. 3 to 8 show schematic side views of the napping machine according to FIG. 1 also showing various cloth tension states.

FIG. 3 shows that the cloth tension is too low at the cloth feed end 3 as well as the cloth delivery end 5, so that two dancing rolls 7, 8 have moved in such a way as to stretch the cloth tube due to the pressure elements 17, 18 which are under a preselected pretension. The positions of the dancing rolls 7, 8 shown here are relayed by the linear analog position feedback transmitters (not shown) to the process computer which is programmed so that in this case it increases the speed of delivery roll 6, and thus the tension on the cloth as a whole.

Figure 4:
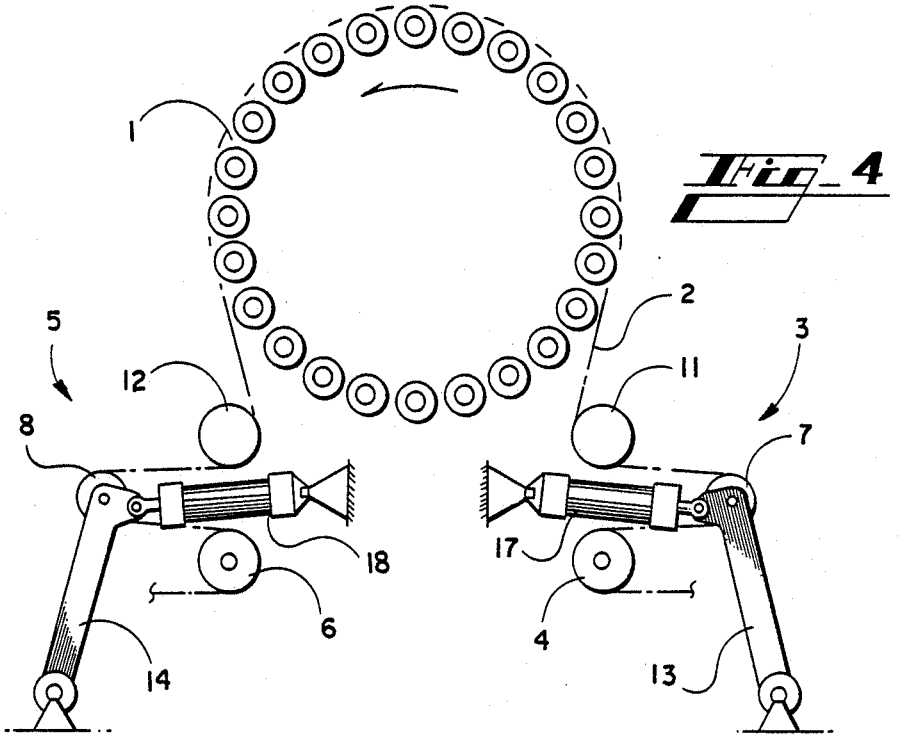

In the condition illustrated in FIG. 4, the cloth tension is too high on the whole, so the computer causes a reduction in the rotational speed of delivery roll 6.

Figure 5:
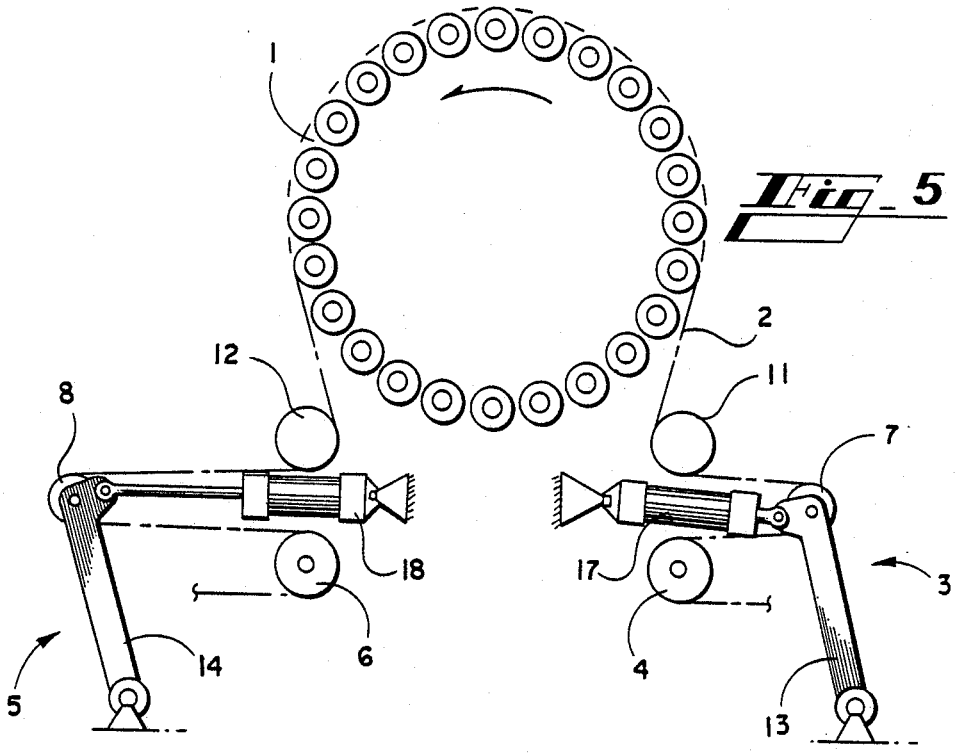

FIG. 5 shows a condition in which the pile-raising energy is too high in relation to the counterpile-raising energy because the cloth 2 is transported too much by cylinder 1 so the cloth is put under tension by the high pull of cylinder 1 at the cloth feed end 3 and the tension is released at the cloth delivery end 5. In this case, the computer causes a reduction in the pile-raising energy, i.e., a reduction in rotational speed of drive motor 22 for the pile rollers.

Figure 6:
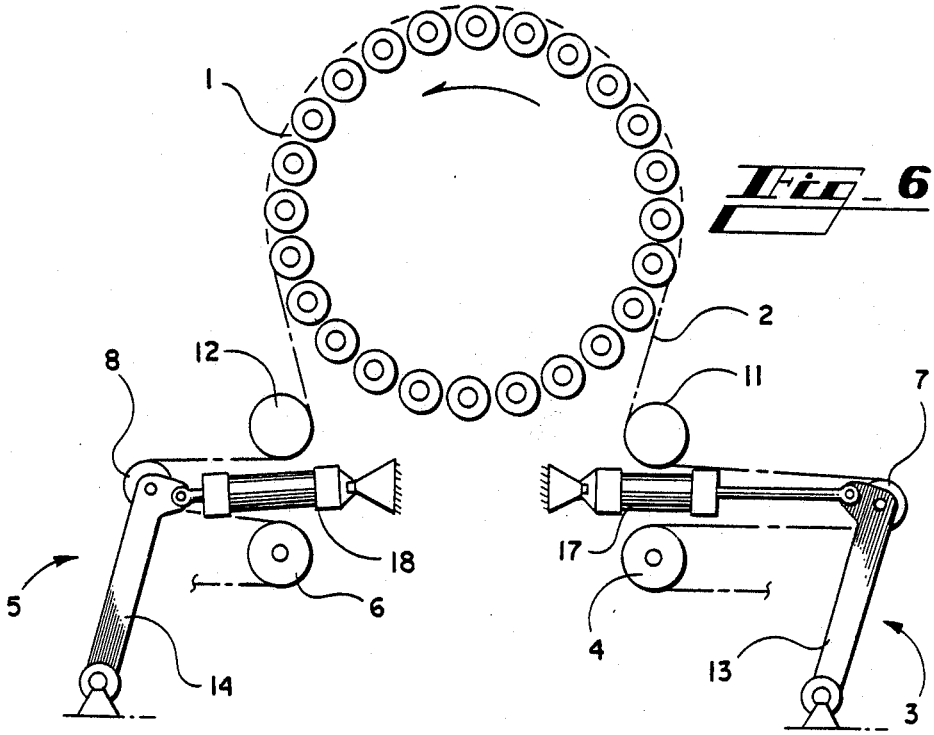

FIG. 6 shows that the pile-raising energy is too low in relation to the counterpile-raising energy. The cloth 2 is subjected to too much energy by the counterpile rollers in the direction opposite the direction of feed of the cloth, so the cloth 2 is relaxed at the cloth feed end 3 and is under tension at the cloth delivery end 5. The required equalization in this case is to increase the pile-raising energy, i.e., increase the speed of drive motor 2 of pile rollers.

Figure 7:
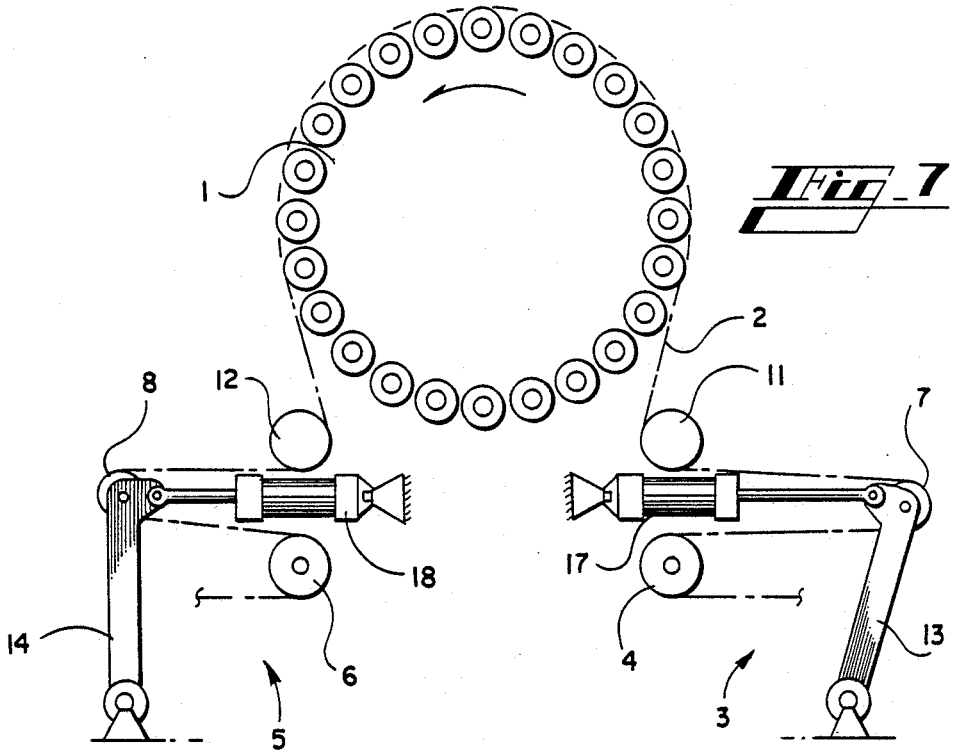

The condition in FIG. 7 shows that the cloth tension is too low and the pile-raising energy is too low. In this case, the computer causes an increase in the rotational speed of the delivery roll 6 by way of motor 5 and an increase in the pile-raising energy by increasing the speed of motor 22.

Figure 8:
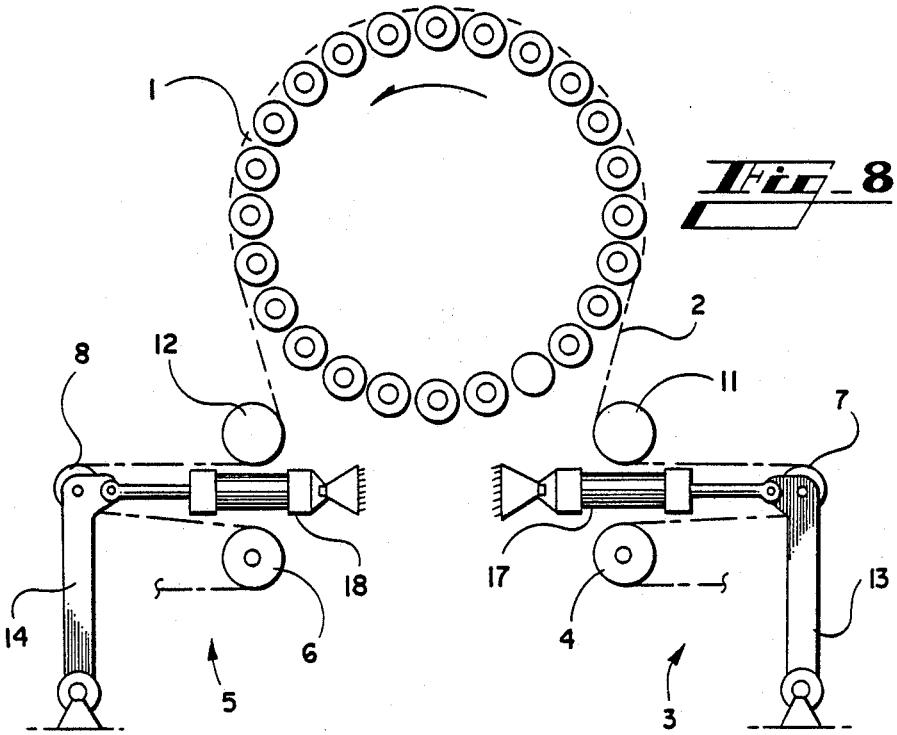

FIG. 8 shows the ideal position of the dancing rolls 7, 8. The differential speed between feed roll 4 and delivery roll 6 has equalized the extensibility of cloth 2 in accordance with the preselected pretension of pressure elements 17, 18. The pile-raising energy in relation to the counterpile-raising energy has been compensates so the cloth tension is distributed absolutely uniformly over the cylinder 1.

Due to the advantageous use of an electronic process computer, the regulation of the independent drive mechanisms is so fast that the ideal conditions shown in FIG. 8 occur immediately after the beginning of processing. Thus FIGS. 3 to 7 serve merely to explain the function of the napping machine according to this invention, and the positions of dancing rolls 7 and 8, which are shown in greatly exaggerated form for the sake of clarity, do not correspond to actual practical conditions.

This invention is by no means limited to the practical examples shown here. In fact, it is quite within the scope of this invention to measure the tension of a length of cloth with other devices that have the same effect, e.g., with wire strain gages, hydraulic or pneumatic pressure measurements, etc. In addition, the dancing rolls 7, 8 may also be mounted so they are linearly movable, i.e., without the pivot lever. It is also possible to completely eliminate the dancing rolls and to measure the cloth tension only through suitable means, e.g., pressure meters in guide rolls 11, 12. However, the design using the dancing rolls 7, 8 has the advantage that a pretension can be set for making adjustments to various types of materials to be processed.

What is claimed is:

1. The process for monitoring and regulating the cloth tension of a length of cloth processed on a cylinder napping machine where the cloth is drawn in at an inlet by a driven feed roller, exposed to pile and counterpile raising energy on the cylinder by pile and counterpile rollers, and drawn off at an outlet by a delivery roll driven independently of the feed roll, and where the actual tension on the length of cloth is measured at the inlet by means of a tension feeler, compared with a selectable preset control value, and automatically adjusted back to the predetermined control value in the event a deviation is found from the control value, comprising the steps of:

continuously measuring the actual cloth tension at the outlet;

comparing the actual values of the cloth tension determined at the inlet and at the outlet with reset control values and also with each other;

automatically readjusting the cloth tension by independent regulation of the rotational speeds of the feed roll, delivery roll, the cylinder, the pile rollers, and the counterpile rollers in response to the comparison of the actual values for the cloth tension at the inlet and outlet ends with each other and with the preset control values; and using a data processing system to compare the actual and control values and to readjust the rotational speeds.

2. Process according to claim 1, further comprising the steps of using dancing rolls to create the preset control value of cloth tension, and using pneumatic pressure elements to position the dancing rolls.

3. Process according to claims 1 or 2, further comprising the step of using dancing rolls to measure the actual values of cloth tension.

4. Process according to claim 1, wherein variable speed dc motors are used to drive the feed roll, delivery rolls, pile and counterpile rollers, and the cylinder.

* * * * *